US010520284B2

(12) United States Patent
Fouques et al.

(10) Patent No.: US 10,520,284 B2
(45) Date of Patent: Dec. 31, 2019

(54) BARREL FOR TARGET LAUNCHING MACHINE WITH RETRACTABLE ROD FOR THE POSITIONING OF AT LEAST ONE COLUMN OF TARGETS

(71) Applicant: LAPORTE HOLDING, Biot (FR)

(72) Inventors: Jean-Marc Fouques, Claviers (FR); Jean-Michel Laporte, Biot (FR)

(73) Assignee: LAPORTE HOLDING, Biot (FR)

( * ) Notice: Subject to any disclaimer, the term of this patent is extended or adjusted under 35 U.S.C. 154(b) by 0 days.

(21) Appl. No.: 16/317,499

(22) PCT Filed: Jun. 29, 2017

(86) PCT No.: PCT/EP2017/066163
§ 371 (c)(1),
(2) Date: Jan. 11, 2019

(87) PCT Pub. No.: WO2018/010967
PCT Pub. Date: Jan. 18, 2018

(65) Prior Publication Data

US 2019/0293393 A1 Sep. 26, 2019

(30) Foreign Application Priority Data

Jul. 11, 2016 (FR) ..... 16 56645

(51) Int. Cl.
*F41J 9/18* (2006.01)
*F41J 9/30* (2006.01)
*F41J 9/20* (2006.01)

(52) U.S. Cl.
CPC .. *F41J 9/30* (2013.01); *F41J 9/20* (2013.01)

(58) Field of Classification Search
CPC ..... F41J 9/18; F41J 9/20; F41J 9/30
See application file for complete search history.

(56) References Cited

U.S. PATENT DOCUMENTS 2,928,383 A * 3/1960 Ohlson ..... F41J 9/30 124/8
5,140,971 A * 8/1992 Heffer ..... F41J 9/30 124/43

(Continued)

FOREIGN PATENT DOCUMENTS

EP 0580914 A1 2/1994
WO 2012032001 A1 3/2012

OTHER PUBLICATIONS

International Search Report from corresponding International Application No. PCT/EP2017/066163, dated Aug. 10, 2017, pp. 1-3, European Patent Office, Rijswijk, The Netherlands.

*Primary Examiner* — John A Ricci
(74) *Attorney, Agent, or Firm* — Hauptman Ham, LLP

(57) ABSTRACT

A barrel intended to be mounted with the ability to rotate about a median axis of rotation on a target launching machine, said barrel comprising at least one column for the storage of targets in a stack, said at least one storage column being positioned at least partially by a rod extending parallel to the storage column, characterized in that the rod comprises a first portion that is stationary relative to the barrel and a second portion that is configured to be able to move at least translationally along a longitudinal axis of the rod between a position deployed along the storage column and an at least partially retracted position.

16 Claims, 3 Drawing Sheets

(56) References Cited

Figure 1:
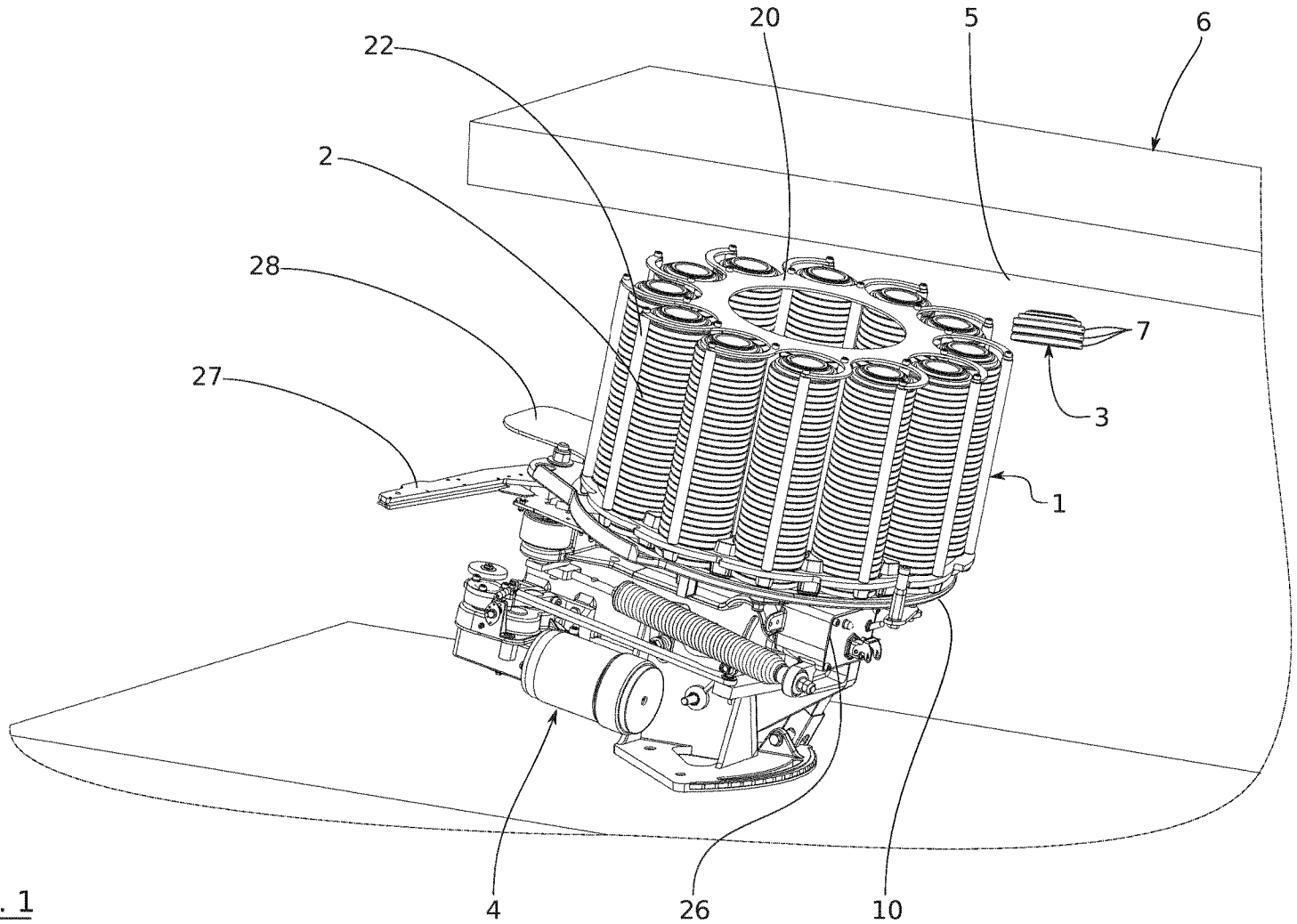

U.S. PATENT DOCUMENTS 5,937,839 A * 8/1999 Nilsson ..... F41J 9/30
124/8
2012/0261883 A1 10/2012 Farmer

* cited by examiner

BARREL FOR TARGET LAUNCHING MACHINE WITH RETRACTABLE ROD FOR THE POSITIONING OF AT LEAST ONE COLUMN OF TARGETS

FIELD OF THE INVENTION

The present invention relates in particular to a barrel intended for a target launching machine and precisely to the filling of targets into a barrel of such a launching machine.

A preferred application relates to the shooting sport industry, and more specifically the flying target shooting industry, also known as "ball-trap" in English-speaking countries.

TECHNOLOGICAL BACKGROUND

Managers of flying target shooting clubs automatize their stands to reduce operating costs. But some actions are difficult to compress or modify. Loading targets into the machines, for example, requires a time during which the installation must be down, this time varying according to the number of machines and the relative positions thereof.

WO-A-2012/032001 discloses a target launching machine with a support and a barrel mounted with the ability to rotate on the support. The barrel has columns at its periphery wherein targets intended to be launched are stacked. The capacity of the barrels varies according to the height and the number of columns. In the end, the number of targets on a launching machine is limited by several factors.

The most important limiting factor is that only one column is associated with a set of rods forming a compartment, the barrel preferably having several compartments.

However, the need to increase the number of targets in a barrel is growing. For optimization purposes, flying target shooting facilities require increasingly capacitive machines. The reloading of machines is a more or less important constraint, depending on its frequency. For safety reasons, it requires a break in activity, the duration of which is linked to the relative positions of the machines, their distance, the structure that houses them, which can be raised, for example a column, or which can be closed and have a limited space, as well as the number of structures.

Thus, it is desirable that the barrels containing the targets should be of the multi-column type. The low relative strength of the lowest targets in a column limits the height of the associated column and in the case of a closed structure, regulations define the dimensional constraints. It is therefore not possible to increase the height of the columns to load more targets into a barrel of such a launching machine. Moreover, this is made impossible by the housing of such a target launching machine in an often cramped frame, wherein the frame roof is very close to the upper surface of the barrel of the launching machine.

Typically, columns are reloaded by inserting stacks of targets from above into each column. The number of targets per stack to reload the machine is thus limited by the distance between the top of the barrel and, in the case of a machine housed in a structure, the roof of said receiving structure. For most facilities, a stack can consist of 3 to 6 or more targets. Thus, reloading target launching machines is long and laborious. This results in a significant down-time cost.

The issue this invention is based on is, for the barrel of a launching machine comprising at least one column at least partially delimited by a rod, to facilitate the filling of the column with targets.

SUMMARY OF THE INVENTION

For this purpose, the present invention relates to a barrel intended to be mounted on a target launching machine, said barrel comprising at least one column for the storage of targets in a stack, said at least one storage column being positioned at least partially by a rod, characterized in that the rod comprises a first portion and a second portion that is configured to be able to move relative to the first portion at least translationally along a longitudinal axis of the rod between a position deployed along the storage column and an at least partially retracted position.

The technical effect is to have a rod for positioning or delimiting at least one column that can be retracted, the retraction being preferably but not restrictively carried out according to at least one translation movement, which also covers the case of a helical slide, and complex movements including preferably a translation. The translation allows a better retraction of the rod than for example, pivoting, with the rod then going out of the barrel in the latter case, which is very disadvantageous when the launching machine is housed in a frame offering a limited working space.

The position deployed along the storage column of the rod(s) ensures that the target stack of the column(s) is properly held in place. Once the barrel is loaded and a position at least partially retracted, each rod clears space and allows targets to be reloaded into the barrel from the outside.

The invention relates to a target launching machine, characterized in that it comprises such a barrel, the targets being stacked by forming said at least one column.

This invention optimizes the size of the barrel, allows the barrel to be loaded in a limited space, which is usually that of a frame housing the machine. The loading rate of the machine filling is increased, resulting in a faster availability of the machine.

Finally, the invention relates to a method for filling a barrel with targets, which is intended to be preferably but not restrictively mounted with the ability to rotate about a central axis of rotation on a target launching machine. Advantageously, said barrel comprises at least one column for the storage of targets in a stack, said at least one storage column being positioned at least partially by a rod extending preferably parallel to the storage column, characterized by a step of at least partially retracting the rod at least by translation along a longitudinal axis of the rod and a step of filling the barrel transversally to the longitudinal direction of the target storage column through a space cleared after at least partial retraction of the rod.

SHORT INTRODUCTION TO THE FIGURES

Figure 2:
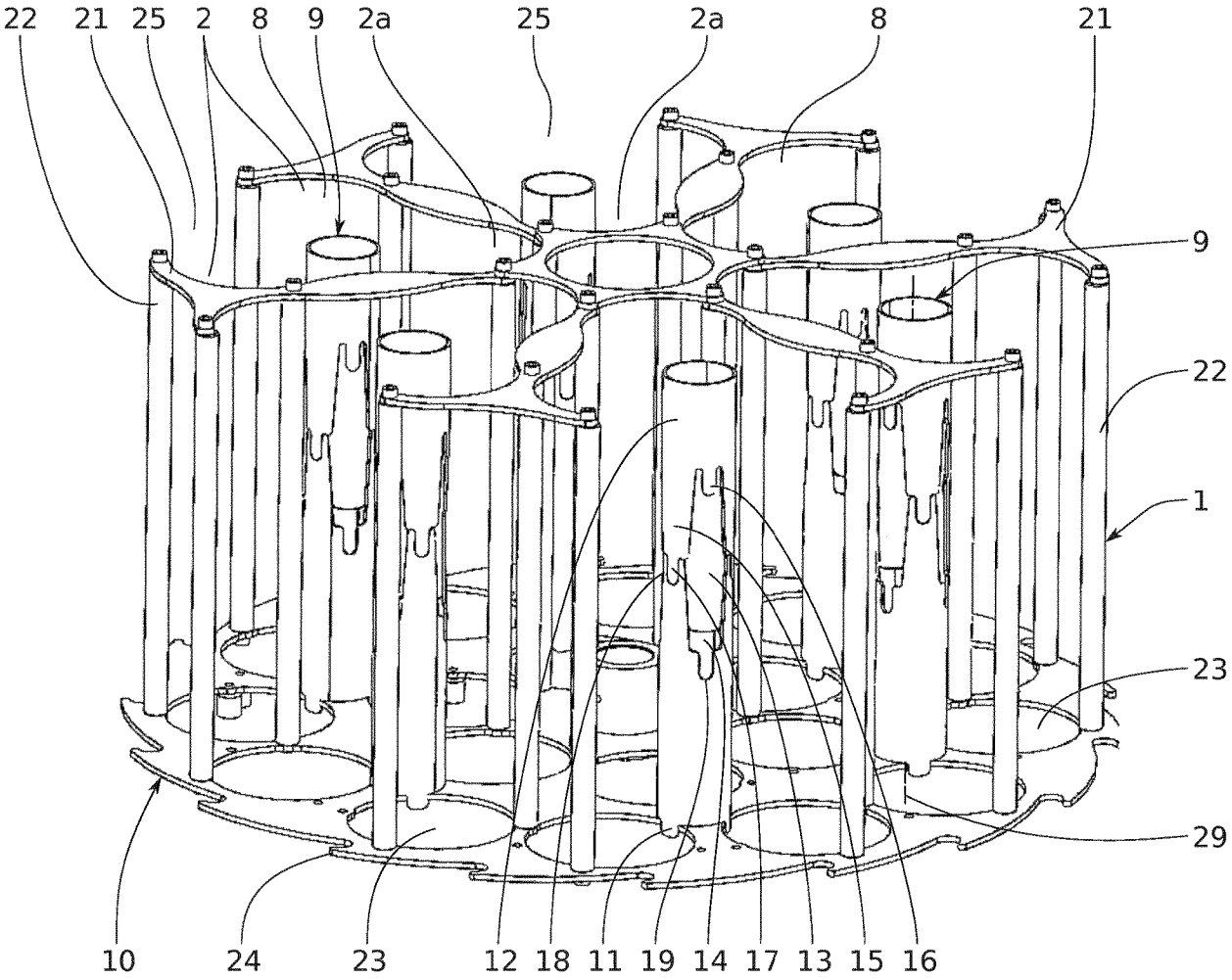
Figure 3:
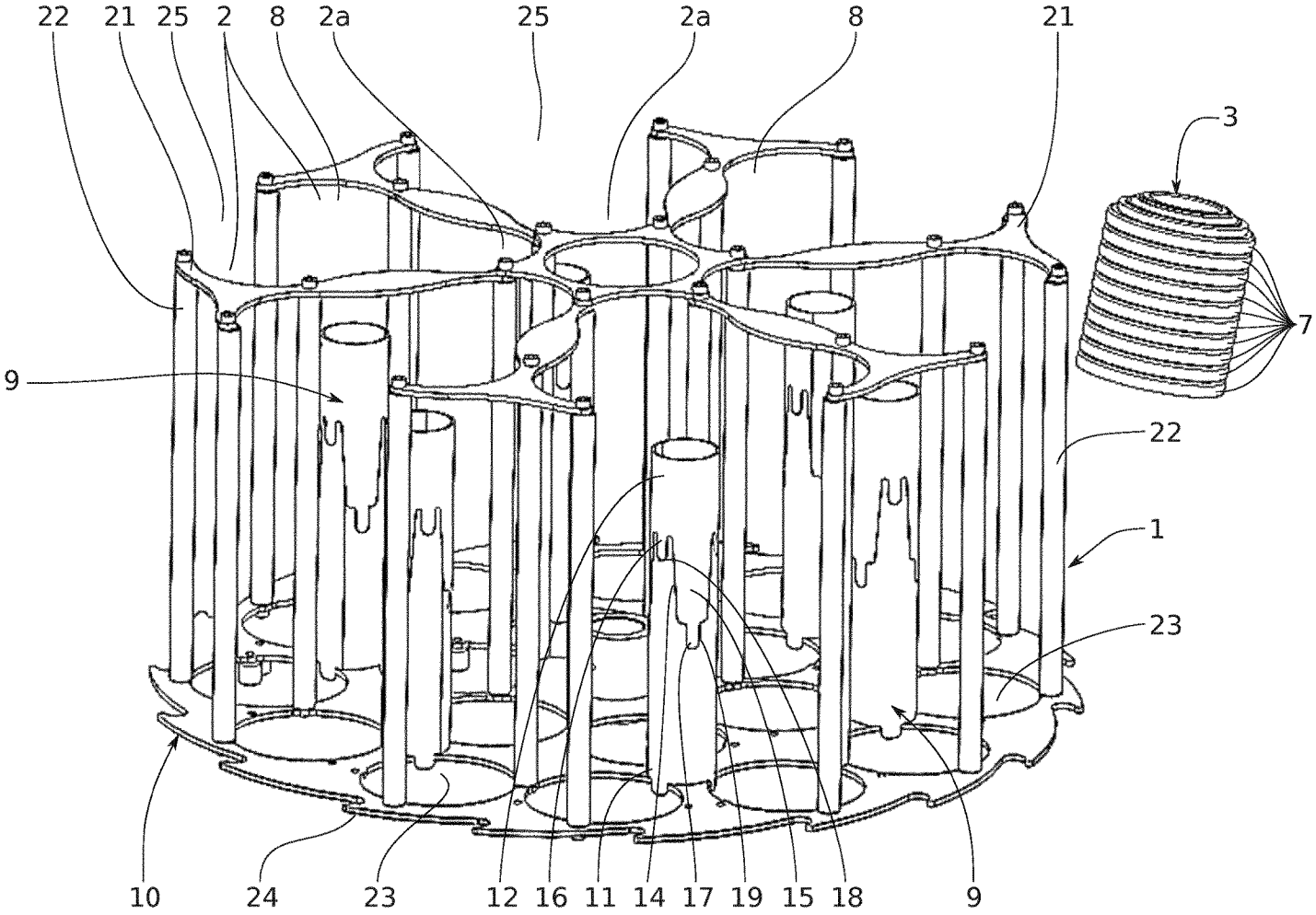

Other characteristics, purposes and advantages of the present invention will appear in the detailed description below, and referring to the appended drawings given as non-exhaustive examples and in which:

FIG. 1 shows a schematic representation of a perspective view of one embodiment of a launching machine comprising a barrel, this barrel may be according to the present invention, FIG. 2 shows a schematic representation of a perspective view of one embodiment of a barrel according to the present invention, the barrel rods being in the deployed position in this figure, FIG. 3 shows a schematic representation of a perspective view of one embodiment of a barrel according to the present invention, the rods of the barrel being in the at least partially retracted position in this figure.

The drawings are given as examples and are not restrictive for the invention. They are schematic representations intended to facilitate the understanding of the invention and are not necessarily on the scale of the practical applications. In particular, the dimensions of the different parts are not representative of reality.

In the following, reference is made to all the figures taken in combination. When reference is made to one or more specific figures, the other figures are to be taken in combination with these specific figures for the recognition of designated numerical references not present on these specific figures.

In some figures, for the sake of simplicity, references are not repeated for each of the elements they should refer to.

In FIG. 1, only one pillar and one column have a reference number. In FIGS. 2 and 3, the longitudinal axis of the rod, the first and second housings, the first and second stops, the tabs and notches are referenced for only one rod in a single compartment. The same applies to the T-shaped parts, the pillars, the distribution passages and the base notches, which are only referenced for one compartment. However, everything mentioned in this description for one of these referenced elements applies to all the similar non-referenced elements illustrated in the figures.

DETAILED DESCRIPTION

Before going into the details of preferred embodiments of the invention with reference to drawings in particular, other optional features of the invention, which may be implemented in any combination or as an alternative solution are indicated below:

the barrel comprises several columns forming a circle of columns centred on the axis of rotation of the barrel. In this configuration, the barrel comprises several compartments delimited by pillars in the form of rods and surrounding at least one column. According to the present invention, at least one of the rods delimiting the compartment can be retracted for a better access to the compartment column.

the barrel has at least two concentric circles of columns. This represents an optimized configuration with advantageously several columns in the same compartment. At least one rod according to the invention is arranged between the two or more columns and can be retracted at least by a translation movement to ensure access to all the columns. The problem of filling several adjacent columns arranged in a barrel is thus solved. This allows in particular the development of multi-column barrels for a larger capacity.

the barrel comprises at least one series of compartments extending all about the median axis of rotation, each compartment comprising at least two columns, the mobile rod being positioned between said at least two columns, the barrel having a substantially cylindrical shape with each compartment having a lateral opening. For example, for a barrel capacity of 400 targets, using a third column increases the capacity by 50%, giving a total of 600 targets. Reloading will then require between 54 and 78 insertions. Thanks to the solution of this invention, the capacity gain is not obtained at the expense of the filling speed, which is itself increased. A major limitation in the use of a barrel with multi-column compartments was the limitation of the filling of the columns with targets, since a column positioning rod is provided in the central portion of each compartment between the columns, this holding rod being contiguous to the three columns. This holding rod obstructed the access to the innermost column in the compartment. This invention solves this problem by at least partially retracting the positioning rod on itself by translation.

each compartment comprises at least three columns, two columns being located at the periphery of the same circle centred on the axis of rotation of the barrel and the third column being located inside the circle. This advantageous characteristic allows an increase in the number of targets present in the barrel without increasing the size of the barrel. The invention can also be used in the opposite configuration, i.e. a circle of external columns with one column per compartment and a circle of internal columns with two columns per compartment. This has the advantage of placing the extra weight due to the two columns near the axis of rotation of the barrel, which limits the increase in the resistive torque upon rotation of the barrel, but this was made impossible according to the state of the art because of the inaccessibility of the two internal columns of each compartment due to the central positioning rod in the compartment. The present invention, by making the rod at least partially retractable in each compartment, makes it possible to have such a very advantageous configuration.

the second portion of the rod is able to move at least translationally and rotationally relative to the first portion about the longitudinal axis of the rod.

the second portion penetrates into or receives at least partially the first portion of the rod.

one of the first and second portions carries at its periphery at least one first stop at its end facing the other portion and at least one tab pointing towards the other portion of the first and second portions and projecting from the opposite end, said at least one tab having a second stop at one free end, the other of the first and second portions having at least one first housing at its end facing said one of the first and second portions and at least one longitudinal notch having at least one second housing at its bottom recessed from the end facing said one of the first and second portions, said at least one notch receiving said at least one tab in the partially retracted position.

in the at least partially retracted position, said at least first and second stops are respectively in said at least first housing and said at least second housing carried by said at least one notch and, in the deployed position, after pivoting the second portion relative to the first portion, said at least second stop is in said at least first housing.

one portion of the first and second portions includes at least two tabs and the other portion includes at least two notches, the second portion being pivoted by at most 90° between the deployed and retracted positions.

one portion of the first and second portions includes at least three tabs and the other portion includes at least three notches, the second portion being pivoted by at most 60° between the deployed and retracted positions. The stops and housings fit into each other every 60 degrees. This alternatively gives the upper position and the lower position of the rod. The upper position is maintained by the coincidence of stops of the tabs of one rod portion with the corresponding housings at the end of the other portion of the rod, the lower position being obtained by a total nesting of all the stops in the housings, the tabs being inserted into the notches.

said at least two or three tabs are carried by the second mobile portion and said at least two or three notches are carried by the first stationary portion.

the first and second portions house a stiffening tube within them.

the first stationary portion of said at least one rod rests on a base of the barrel by being secured to this base, the base being substantially circular by presenting notches on its periphery.

Referring to FIGS. 1 to 3, the present invention relates to a barrel 1 and a launching machine 4 comprising such a barrel 1, the barrel 1 enabling an easy filling with targets 7 inside same, the targets 7 being arranged in stacks forming columns 2. In the figures, the targets 7 in the columns 2, 2*a* are materialized by stacks of targets, as in FIG. 1, or left empty as in FIG. 2. FIG. 3 shows, as an indication, a portion of a stack 3 comprising several targets 7 away from the barrel 1. It is a respective stack 3 of stacked targets 7 that fills and materializes each of the columns 2, 2*a* shown in FIGS. 2 and 3.

FIG. 1 shows a machine 4 for launching targets 7 the barrel 1 of which is easy to fill as compared to a barrel of a conventional machine while keeping identical general dimensions. The barrel consists of only one series of stacks of targets forming columns 2 located on the same circle concentric to the axis of rotation in the centre of the barrel 1.

The machine 4 for launching targets 7 advantageously includes a chassis 26 used as a support for the barrel 1. The launching machine 4 also includes a launch arm 27 and a launch plate 28.

In FIG. 1, the barrel 1 comprises, on the one hand, a plurality of columns 2 for the storage of targets 7 which are located at the periphery of a circle having as its centre the central axis of rotation of the barrel 1. In FIGS. 2 and 3, the barrel 1 includes, in addition to the plurality of columns 2 on a first circle, a plurality of storage columns 2*a* on a second circle concentric to the first one and having a smaller diameter, which enables an additional storage of targets 7. This defines one or more external column(s) 2 and one or more internal column(s) 2*a*. The external columns 2 are advantageously further away from the center of the barrel 1 than the central columns 2*a*.

The targets 7 are stored in stacks inside said storage columns 2, 2*a*. A large portion of the volume of the barrel 1 can thus be filled with columns 2, 2*a* of targets 7 stacked on top of each other except for a central portion forming an empty space surrounding the central axis of rotation of the barrel 1, this central portion being preferably delimited by a star-shaped central part 20, which is best visible in FIGS. 2 and 3.

Generally speaking, the barrel 1 operates in this example successive rotations configured to deliver the targets 7, at least one per column, from all the columns 2, 2*a*. A rotation, in several steps, of 360°, corresponds to a complete cycle.

As previously mentioned and with reference in particular to FIG. 1, such a target 7 launching machine 4 is housed in a frame 6 defining a restricted inner space with the roof 5 of the frame 6 overhanging at a short distance an upper face of the barrel 1. As a result, filling the barrel 1 from above is difficult and few targets 7 can be introduced into the barrel 1 at a time.

Generally speaking, the present invention relates to a barrel 1 comprising at least one column 2, 2*a* for the storage of targets in a stack 7, so not necessarily a set of columns 2, 2*a* regularly distributed around a circle as shown in FIG. 1 or around two concentric circles as shown in FIGS. 2 and 3.

In such a barrel 1, in FIGS. 2 and 3, the storage column(s) 2, 2*a* is/are at least partially delimited by a rod 9. Preferably the rod 9 has a non-zero component along the longitudinal direction of the columns and, advantageously, extends parallel to the storage column(s) 2, 2*a*, advantageously framed by the storage columns 2, 2*a*. In FIG. 1, the positioning rod can be a pillar 22 located towards the outside of the barrel. Advantageously, at least three rods 9 delimit a column and these rods 9 are preferably evenly spaced around the column. In cross-section, in the case of three rods 9, the three points of contact between the rods 9 and the targets form an equilateral triangle inscribed in the circular section of the targets. Any elongated element, whether straight or not, may be suitable for forming a rod 9. It can be a bar with a solid or hollow circular section.

This rod 9 is visible in FIGS. 2 and 3. The rod 9 adjoins one or more storage column(s) 2, 2*a* and is used to hold the stack 3 of targets 7 in place, thus avoiding an inclination of the column(s) 2, 2*a* thus formed and to prevent a possible collapse of the column(s) 2, 2*a*. The rod 9 need not be attached to the column(s) 2, 2*a* and only holds the column(s) 2, 2*a* in position by abutment.

In FIGS. 2 and 3, the barrel 1 has several compartments 8 surrounding at a distance the axis of rotation of the barrel 1 and each housing three columns 2, 2*a* surrounding a positioning rod 9. Preferably, in one embodiment of the invention, two columns 2 of each compartment 8 are located at the periphery of a first circle and the third columns 2*a* of the compartments 8 are located at the periphery of a second circle having a smaller diameter than the first circle. The first and second columns 2 form a ring concentric to the axis of rotation of the barrel 1 while the third columns 2*a* form a concentric ring having a smaller diameter. Advantageously, the columns 2 are external columns 2, and the columns 2*a* are central columns 2*a*.

This is not restrictive and the present invention may relate to a barrel 1 equipped with a single column 2, 2*a* or several columns 2, 2*a* provided that a rod is associated with the column 2, 2*a* or columns 2, 2*a* of the barrel 1.

As shown in particular in FIGS. 2 and 3, according to the invention, the rod 9 comprises a first portion 11 that is stationary relative to the barrel 1 and a second portion 12 configured to be able to move at least translationally along a longitudinal axis 29 of the rod 9 between a position deployed along the storage column 2, 2*a* of and an at least partially retracted position. The longitudinal axis is only visible in FIG. 2.

As a result, the length of the rod 9 in the height of the barrel 1 can be reduced. This leaves a space for the lateral introduction of targets 7 into the barrel 1 and simplifies the filling of the barrel 1, the insertion space between a barrel 1 with its substantially vertical axis of rotation and the inner wall of the roof 5 of frame 6 being very small.

In one embodiment of the invention, the rod 9 can be completely retracted. In this case, the complete retraction of the rod 9 is not mandatory. Only a part of the mobile portion of the rod 9 can be retracted. The mobile portions 12 and the stationary portions 11 may be of substantially the same length, which is not restrictive. The part of the mobile portion 12 may, in a non restrictive embodiment of the invention, be retracted from one-fifth to one-half of the total length of the rod 9.

The retracting movement can be a simple translation, for example for a telescopic rod 9 the mobile part retracting without or on the stationary part, being advantageously but not necessarily returned to the deployed position by a return element. Preferably, the retracting movement is a sequence of movements including one or more translation(s) combined with one or more pivoting of the mobile portion about the longitudinal axis 29 of the rod 9. A preferred embodiment will be described in greater details later.

As previously mentioned, with reference in particular to FIGS. 2 and 3, the barrel 1 may comprise at least one series of compartments 8 extending around the median axis of rotation. In a preferential embodiment of the compartments 8, the barrel 1 may include a base 10 formed by a disc with notches 24 on its periphery to cooperate with the launch arm 27 of the launching machine 4, which is visible in FIG. 1.

The first stationary portion 11 of the rod(s) 9 contained in the barrel 1 can thus rest on a base 10 of the barrel 1 by being secured to this base 10. The base 10 of the barrel 1 is substantially circular and includes distribution passages 23 in the form of a cavity with dimensions preferably larger than those of a target 7, respectively. These distribution passages are used to supply targets 7 to the machine 4 starting with the lowest target 7 through the base 10 of the barrel 1, the barrel being then advantageously in a vertical position or close to the vertical.

The barrel 1 includes a face opposite the base 10, called the upper face. This upper face preferably includes a star-shaped central part 20 centred on and remotely surrounding the axis of rotation of the barrel 1. In another embodiment, the different rods 9 can be connected to each other at their vertices by means of rectilinear parts. The purpose of this connection between the tops of the rods 9 is to stiffen the entire barrel 1. In the preferred embodiment comprising a star-shaped part, each branch of the star-shaped central part 20 points radially outwards and is secured to a T-shaped part 21 by the base of the T. Two adjacent T-shaped parts 21 delimit between them a compartment 8 which houses in its interior one or more column(s) 2, 2*a* and the at least partially retractable rod 9.

The base 10 of the barrel 1 is connected to the T-shaped parts 21 and the star-shaped central part 20 by a series of pillars 22, the pillars 22 being advantageously in the form of rods. There can be four pillars 22 per T-shaped part 21, i.e. two at the ends of the T head, one in the middle of the vertical bar of the T and one at the base of the T. Six compartments 8 i.e. six branches for the star-shaped central part 20 can be defined per barrel 1, one compartment 8 considered being defined by two adjacent T-shaped parts 21, each T-shaped part 21 also defining one compartment 8 adjacent to the compartment 8 considered. A T-shaped part 21 is therefore common to two adjacent compartments 8. Pillars 22 are common to each base 10 of the T-shaped part 21 and each branch of the star-shaped central part 20.

In a preferred embodiment of the target support 7, the pillars 22 and the rod 9 cooperate to hold the columns 2, 2*a* in each compartment, one compartment 8 comprising several columns 2, 2*a* and the rod 9 being preferably arranged in the middle of the columns 2, 2*a*, themselves surrounded by the pillars 22.

In the embodiment of FIG. 1, a pillar 22 can be used as a positioning rod for a single column 2. It can be recognized that it is this pillar 22 visible in FIG. 1 that must be retractable for reloading the column 2 with targets, otherwise the column 2 could only be reloaded through the upper side of the barrel 1.

All these elements give the barrel 1 a substantially cylindrical and mostly hollow shape. For a compartment 8, between two T-shaped parts 21 delimiting it and the pillars 22 of the corresponding ends of the T-head, a lateral opening 25 between the pillars 22 of two T-pieces 21 is kept clear, this lateral opening 25 being advantageously wider than the spacing between two pillars 22 associated with the same T-shaped part 21. The targets 7 can be introduced into each compartment 8 of the barrel 1 through these lateral openings 25 when the rod 9, which is advantageously located in the middle of the compartment 8 and extends from the base 10 to the upper surface of the barrel 1, is at least partially retracted.

In the preferential embodiment of the invention, each compartment 8 may comprise at least three columns 2, 2*a*, two columns 2 being located at the periphery of the same first circle centred on the axis of rotation of the barrel 1 and the third column 2*a* being located inside the circle on a circle concentric to the first circle but having a smaller diameter.

In a volume inside each compartment 8 of the barrel 1, the rod 9 can be found in a median longitudinal part of the compartment, the columns 2, 2*a* being arranged at equal distance from the rod 9 which is parallel thereto.

The outline of the or each compartment 8 is defined by the base 10 of the barrel 1, the only substantially closed element of the compartment, a part of two T-shaped parts 21, namely an end of the T-head and the T-body, and the pillars 22, advantageously six pillars 22 with three pillars 22 per T-shaped part 21, as well as a part inserted between two branches of the star-shaped central part 20.

In one embodiment of the barrel 1, there can be 6 compartments 8 per barrel 1, each compartment 8 comprising 3 columns 2, 2*a* of targets 7, i.e. 18 columns 2, 2*a*. However, the numbers of storage columns 2, 2*a* and of compartments 8 are not restrictive.

All the storage columns 2, 2*a* of the same barrel 1 can have the same diameter. Thus, the diameter of a storage column 2, 2*a* is advantageously between 80 mm (mm or $8.10^{-2}$ meters) and 130 mm and is preferably between 105 and 115 mm, more precisely 112 mm. The diameter of a barrel 1 for one embodiment with approximately 18 storage columns 2, 2*a* advantageously is between 400 and 900 mm.

A preferential mode of retraction of one or more rod(s) 9 present in a barrel 1 according to the present invention will now be described. This preferential mode is not restrictive.

In this preferential mode, the second portion 12 of the rod 9 can be able to move at least translationally along the longitudinal axis 29 of the rod 9 and rotationally about the longitudinal axis 29 of the rod 9 relative to the first portion 11. The second portion 12 can penetrate into or at least partially receive the first portion 11 of the rod 9. A second portion 12 that fits into the first portion 11 is preferred. It is possible to provide a stiffening tube 13 housed inside the first and second portions 11, 12 of the rod 9.

FIGS. 2 and 3 show a barrel 1 with rods 9 in the deployed position and in the at least partially retracted position respectively. In the preferential embodiment, one of the first and second portions 11, 12 carries at its periphery at least one first stop 16 at its end facing the other portion and at least one tab 15 pointing towards the other portion of the first and second portions 11, 12 projecting from the opposite end. The tab(s) 15 has/have a second stop 17 at one free end.

In FIGS. 2 and 3, the second mobile portion 12 that carries three tabs 15 uniformly distributed around the second substantially cylindrical mobile portion 12.

The other one of the first and second portions 11, 12, in FIGS. 2 and 3 the first stationary portion 11, may have at least one first housing 18 at its end facing said one of the first and second portions 11, 12, i.e. the second mobile portion 12. The other one of the first and second portions 11, 12, in FIGS. 2 and 3 the first stationary portion 11, may have at least one longitudinal notch 14 with its bottom comprising at least one second housing 19.

The bottom of the notch 14 or each notch 14 is therefore recessed relative to the end of this portion, here the first stationary portion 11 opposite the second mobile portion 12. There are as many notches 14 as there are tabs 15 in FIGS. 2 and 3, i.e. three of them, and each notch 14 receives a tab 15 in the partially retracted position.

In FIGS. 2 and 3, the tabs 15 are received in the notches 14 in the at least partially retracted position. The first and second stops 16, 17 are respectively in the second housing(s) carried by the or each notch 14 and the first housing(s).

In FIG. 2, in the deployed position, after pivoting the second portion 12 relative to the first portion 11 about the longitudinal axis 29 of the rod 9, the second stop(s) 17 of the tab(s) 15 is/are in the first housing(s) 18.

In FIG. 3, in the at least partially retracted position, the first stop(s) 16 is/are in the first housing(s) 18 and the second stop(s) 17 of the tab(s) 15 is/are in the second housing(s) 19 carried by the notch(es) 14.

In a first alternative solution belonging to the preferential mode, one portion of the first and second portions 11, 12 may include at least two tabs 15 and the other portion includes at least two notches 14. In this case, the second mobile portion 12 is rotated about the longitudinal axis 29 of the rod 9 by at most 90° between the deployed and retracted positions.

In the preferred alternative solution, one portion of the first and second portions 11, 12 may include at least three tabs 15 and the other portion 12 comprises at least three notches 14. In this case, the second mobile portion 12 is rotated about the longitudinal axis 29 of the rod 9 by at most 60° between the deployed and retracted positions.

In this preferential mode, the tab(s) 15, for example three tabs 15, is/are carried by the second mobile portion 12 and notch(es) 14, in a number corresponding to the tabs 15, are advantageously carried by the first stationary portion 11.

The kinematics of passing from a deployed position to an at least partially retracted position during the process 7 of filling a barrel 1 with targets 7 can be the following:

In the deployed position, the stop of each tab 15 carried by a first or a second portion 12 has its second stop 17 inserted into a first housing 18 at one end of the other first or second portion 12. A first translation is then carried out to a larger deployment of the rod 9 to pull out the second stop(s) 17 from their respective first housing 18.

The rod 9 is then pivoted about its longitudinal axis 29, the axis being shown only in FIG. 2, in order to position the or each tab 15 opposite a notch 14 or the notch 14.

Eventually, a second translation of the second mobile portion 12 is performed towards the first stationary portion 11 with a reduction in the length of the rod 9 in relation to the amplitude of the translation and in the direction opposite the direction of the first translation. This translation is stopped by inserting the second stop(s) 17 into a respective second housing 19 of the notch(es) 14. Simultaneously the first stop(s) 16 penetrate(s) into the first housing(s) 18. The retracted position of the rod 9 is stable as long as the second mobile portion 12 is not driven translationally away from the first mobile portion 11.

More generally, the invention eventually relates to a method for filling a barrel 1 with targets 7 intended to be mounted with the ability to rotate about a median axis of rotation on a target 7 launching machine 4, said barrel 1 comprising at least one column 2, 2*a* for storing targets 7 in a stack, said at least one storage column 2, 2*a* being positioned at least partially by a rod 9 extending parallel to the storage column 2, 2*a*.

The method includes a step of at least partially retracting the rod 9 at least by translation along a longitudinal axis 29 of the rod 9. This step is followed by a step of filling the barrel 1, laterally to the barrel 1, through a space cleared after the at least partial retraction of the rod 9.

In the preferred embodiment of the barrel 1 with compartments 8 housing the rod 9, this is done through the lateral opening 25 provided in each compartment 8 of the barrel 1.

The invention is not limited to the embodiments previously described but extends to all embodiments in accordance with the spirit thereof.

In addition, it is of course understood that all the examples relating to machines 4 with a specific number of storage columns 2, 2*a* are not restrictive examples in order to specify and explain the invention. Arrangements other than the ring are also possible.

REFERENCES

1. Barrel
2. Column
2*a*. Column
3. Stack
4. Launching machine
5. Roof
6. Frame
7. Target
8. Compartment
9. Rod
10. Base
11. First stationary portion
12. Second mobile portion
13. Stiffening tube
14. Notch
15. Tab
16. First stop
17. Second stop
18. First housing
19. Second housing
20. Star-shaped central part
21. T-shaped part
22. Pillar
23. Distribution passage
24. Notch
25. Side opening
26. Chassis
27. Arm
28. Plate
29. Longitudinal axis

The invention claimed is:

1. A barrel intended to be mounted on a target launching machine, said barrel comprising at least one column for a storage of targets in a stack, said at least one storage column being delimited at least partially by a rod, wherein the rod comprises a first portion, and a second portion that is configured to be able to move relative to the first portion at least translationally along a longitudinal axis between a position deployed along the storage column and an at least partially retracted position.

2. The barrel according to claim 1, which comprises a plurality of columns arranged in a circle of columns centred on an axis of rotation of the barrel.

3. The barrel according to claim 2, which comprises at least two concentric circles of columns.

4. The barrel according to claim 1, wherein the barrel comprises at least one series of compartments extending all about a median axis of rotation, each compartment comprising at least two columns, the rod being positioned between said at least two columns.

5. The barrel according to claim 4, wherein each compartment comprises at least three columns.

6. The barrel according to claim 5, wherein two columns are configured to be positioned on a periphery of the same circle centered on the axis of rotation of the barrel and a third column of the at least three columns is configured to be positioned inside the circle.

7. The barrel according to claim 5, wherein the second portion penetrates into, or at least partially receives the first portion of the rod and wherein, in the at least partially retracted position, said at least first and second stops are respectively in said at least first housing and said at least second housing carried by said at least one notch and, in the deployed position, after pivoting the second portion relative to the first portion, said at least second stop is in said at least first housing.

8. The barrel according to claim 7, wherein one of the first portion and second portion includes at least two tabs and another of the first portion and second portion includes at least two notches, the second portion being pivoted by at most 90° between the deployed position and retracted position.

9. The barrel according to claim 8, wherein said at least two tabs are carried by the second portion which is mobile and said at least two notches are carried by the first portion which is stationary.

10. The barrel according to claim 8, wherein the first portion and second portion house a stiffening tube within them.

11. The barrel according to claim 4, wherein one of the first portion and second portion includes at least three tabs and another of the first portion and second portion includes at least three notches, the second portion being pivoted by at most 60° between the deployed position and retracted position.

12. The barrel according to claim 1, wherein the second portion of the rod is able to move at least translationally and rotationally relative to the first portion about the longitudinal axis of the rod.

13. The barrel according to claim 1, wherein the second portion penetrates into, or at least partially receives the first portion of the rod.

14. The barrel according to claim 13, wherein one of the first portion and second portion is configured to carry on its periphery at least one first stop at its end facing the other portion and at least one tab pointing towards the other portion of the first portion and second portion and sticking out from the facing end, said at least one tab having a second stop at one free end, the other of the first portion and second portion having at least one first housing at its end facing said one of the first portion and second portion and at least one longitudinal notch having at least one second housing at its bottom recessed from the end facing said one of the first portion and second portion, said at least one notch receiving said at least one tab in the at least partially retracted position.

15. A machine for launching targets comprising a barrel according to any one of the preceding claims, the targets being stacked by forming said at least one column.

16. A method for filling a barrel intended to be mounted with the ability to rotate about a median axis of rotation on a target launching machine with targets, said barrel comprising at least one column for a storage of targets in a stack, said at least one storage column being positioned at least partially by a rod extending parallel to the storage column and comprising a step of at least partially retracting the rod at least by translation along a longitudinal axis of the rod (9) and a step of filling the barrel laterally to the barrel through a space cleared after at least partially retracting the rod.

* * * * *